US007611135B2

(12) United States Patent
Kaya

(10) Patent No.: US 7,611,135 B2
(45) Date of Patent: Nov. 3, 2009

(54) INSERTER WITH CLOSURE DEVICE

(75) Inventor: Mehmet Oktay Kaya, Lee, NH (US)

(73) Assignee: Goss International Americas, Inc., Durham, NH (US)

( * ) Notice: Subject to any disclaimer, the term of this patent is extended or adjusted under 35 U.S.C. 154(b) by 241 days.

(21) Appl. No.: 11/294,266

(22) Filed: Dec. 5, 2005

(65) Prior Publication Data

US 2007/0126166 A1 Jun. 7, 2007

(51) Int. Cl.
*B65H 37/04* (2006.01)

(52) U.S. Cl. ..... 270/52.18; 270/52.14; 270/52.16; 270/52.19; 270/52.22

(58) Field of Classification Search ..... 270/52.14, 270/52.16, 52.18, 52.19, 52.22; 53/136.3, 53/415

See application file for complete search history.

(56) References Cited

U.S. PATENT DOCUMENTS 4,046,367 A * 9/1977 Merker et al. ..... 270/52.24
4,723,770 A 2/1988 Seidel et al. ..... 270/55
4,974,824 A 12/1990 Kimbel et al. ..... 270/58
4,989,852 A * 2/1991 Gunther, Jr. ..... 270/56
5,186,443 A 2/1993 Manley et al. ..... 270/1.1
5,428,937 A 7/1995 Misik et al. ..... 53/74
5,632,476 A * 5/1997 Stauber ..... 270/52.19
5,713,565 A * 2/1998 Meier ..... 270/52.16
6,082,724 A 7/2000 Kahlig et al. ..... 270/52.14
6,311,968 B1 11/2001 Linder et al. ..... 270/52.25
6,705,608 B2 3/2004 Kish et al. ..... 271/206

* cited by examiner

*Primary Examiner*—Gene Crawford
*Assistant Examiner*—Leslie A Nicholson, III
(74) *Attorney, Agent, or Firm*—Davidson, Davidson & Kappel, LLC

(57) ABSTRACT

An inserter includes a hopper section including a plurality of hoppers for delivering inserts and a conveyor carrying a plurality of folded printed products, the printed products receiving at least one insert from the hopper section. A closure device applies a sealing element to an edge of one of the plurality of printed products containing the at least one insert. A newspaper and method are also provided.

24 Claims, 4 Drawing Sheets

INSERTER WITH CLOSURE DEVICE

BACKGROUND

The present invention relates to an apparatus for use in forming sheet material assemblages.

U.S. Pat. No. 4,974,829 discloses a method of distributing newspapers. The method includes collating newspaper inserts together, wrapping collated inserts to provide a separate wrapped package, collating newspaper sections together and distributing to a customer the collated newspaper sections and wrapped package of inserts. The wrapping includes applying plastic sheeting about the collated inserts and sealing the sheeting around the collated inserts.

U.S. Pat. No. 5,428,937 discloses a machine for packaging newspapers. The principles of this invention relate to improving the manner in which the sheets of protective material are deployed over the top and bottom surfaces of a newspaper as it is carried through the newspaper wrapping machine.

U.S. Pat. Nos. 4,723,770 and 6,311,968, disclose top grippers for holding open a first set of printed materials so that a second set of printed material may be inserted into the first set of printed materials.

U.S. Pat. No. 5,186,443 discloses a method of collating newspapers to contain materials which vary as a function of characteristics of the readers of the newspapers. U.S. Pat. No. 5,186,443 also discloses a method of collating newspapers with printed indicia identifying a reader.

U.S. Pat. No. 6,705,608, hereby incorporated by reference herein, discloses a sheet material conveying apparatus having at least one pocket running along a track, the pocket including a base section for receiving sheet material and an upper section including at least one gripper for holding the edge of the sheet material. U.S. Pat. No. 6,705,608 also discloses a method for setting a distance of a top gripper of a pocket.

U.S. Pat. No. 6,082,724, hereby incorporated by reference herein, discloses an apparatus for use in forming sheet material assemblages. The apparatus includes a plurality of article feeder assemblies disposed along a conveyor.

BRIEF SUMMARY OF THE INVENTION

An object of the present invention is to provide a device and/or method for providing printed products with inserts held therein in an efficient and cost effective manner. An alternate or additional object of the present invention is to provide such a product with inserts.

The present invention provides an inserter comprising:

a hopper section including a plurality of hoppers for delivering inserts;

a conveyor carrying a plurality of folded printed products, the printed products receiving at least one insert from the hopper section, and a closure device applying a sealing element to an edge of one of the plurality of printed products containing the at least one insert.

The printed products with inserts advantageously can be sealed in a cost-effective and efficient manner. The sealed products also advantageously can be stacked and stored more easily than bagged printed products.

The closure device may include grippers that have movable legs and a main section. The movable legs may have cam followers attached. The grippers then may apply sealing elements to the printed products.

The closure device may include a sealing element storage or stack for holding the sealing elements. The closure device also preferably includes an applicator for applying adhesive to the sealing elements and depositing the sealing elements onto the grippers.

The present invention also provides a newspaper including a jacket composed of, for example, a printed publication, newspaper section or other folded material, inserts placed inside the folded jacket, and a sealing element closing the jacket. The newspaper may also include a protective cover.

The present invention also provides a method for closing a plurality of folded printed products while the printed products are carried along a conveyor comprising the steps of:

moving the plurality of the folded printed products through the hopper section, inserts being deposited into the folded printed products;

moving the plurality of the folded printed products having the inserts along the conveyor;

synchronizing a closure device with the conveyor;

applying a sealing element to one of the folded printed products having the inserts using the closure device so as to define a sealed printed product; and transporting the sealed printed product further along the conveyor.

Preferably, the sealed printed product is a newspaper.

The applying step may also include making contact with the newspaper by rotating the legs of the gripper around the edge of the newspaper and applying pressure to the newspaper from the legs of the gripper.

BRIEF DESCRIPTION OF THE DRAWINGS

The present invention will be elucidated with reference to a preferred embodiment, in which.

DETAILED DESCRIPTION OF A PREFERRED EMBODIMENT

Figure 1:
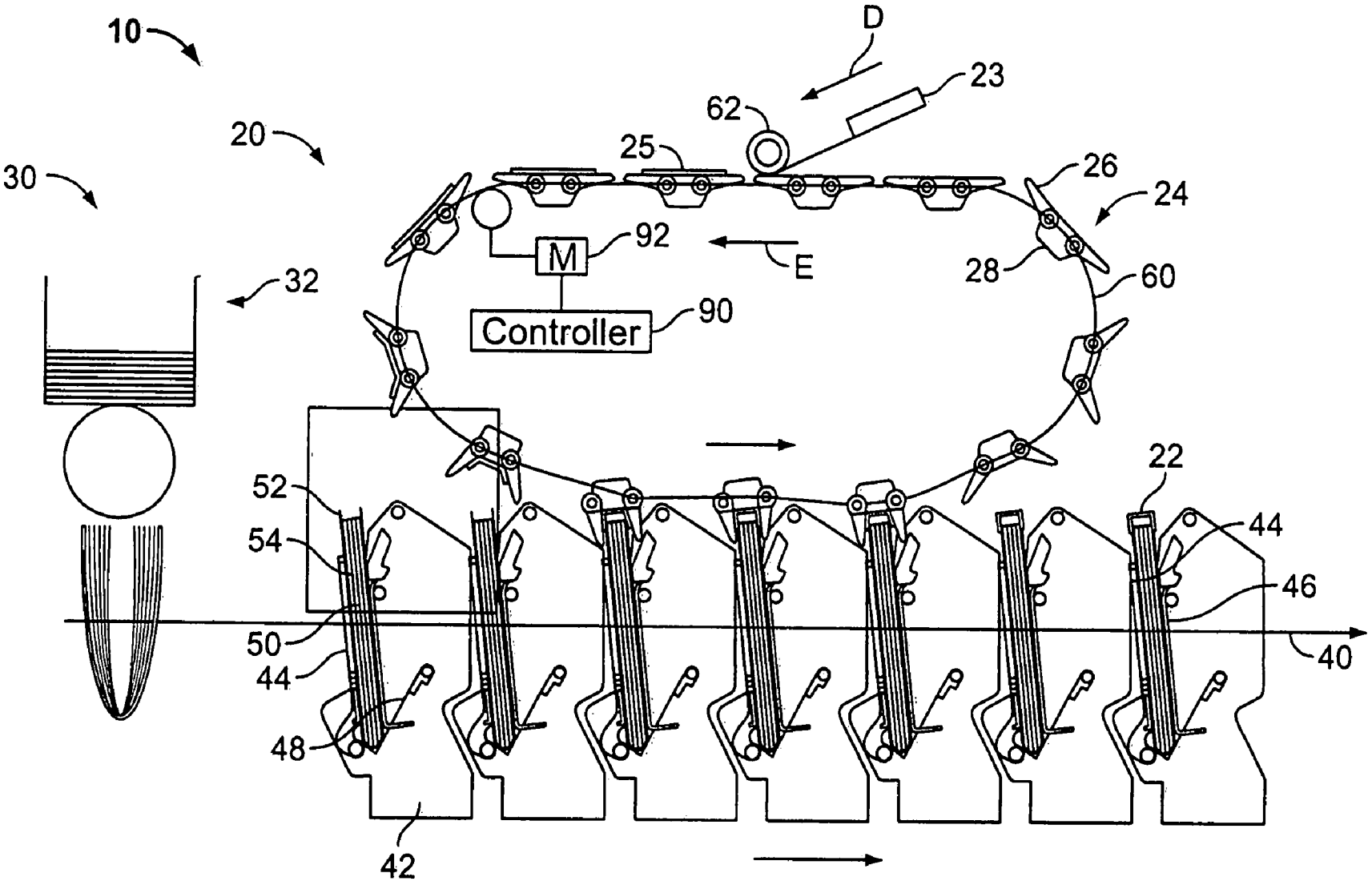
FIG. 1 shows a side view of an inserter according to the present invention.

FIG. 1 shows an inserter 10 having a hopper section 30, which may include a plurality of hoppers 32. U.S. Pat. No. 6,082,724, hereby incorporated by reference herein, for example shows a plurality of possible hoppers. Inserter 10 also includes a conveyor 40, for example, an in-line or linear conveyor, including a plurality of pockets 42. Each pocket 42 includes pocket walls 44, 46 and a bottom gate 48. Pocket walls 44, 46 include a movable wall 44 and a fixed wall 46. Bottom gate 48 can open and movable wall 44 can move toward and away from the fixed wall 46.

A newspaper 50 includes a jacket 52 and inserts 54 collected in pocket 42. Jacket 52 may include a plurality of newspaper sections or other printed, folded material. The height of jacket 52 also extends above pocket walls 44, 46. Jacket 52 may also extend laterally beyond the sides of pocket walls, 44, 46, for example, into or out of the page in FIG. 1.

Inserter 10 includes a closure device 20. Closure device 20 includes grippers 24 and a gripper conveyor 60. Grippers 24 have movable legs 26 and a main section 28. Grippers 24 move along gripper conveyor 60 via main section 28.

Closure device 20 includes a sealing element storage or stack 23 having a plurality of sealing elements 22. Sealing elements 22 may be led individually past an applicator 62 in direction D and may arrive individually onto grippers 24.

Gripper 24 holds sealing element 22 and applies sealing element 22 to outer surface of jacket 52. Sealing element 22 may be paper or plastic material and may have adhesive on one side, for example via glue provided by applicator 62. The adhesive side 25 faces up and away from gripper 24 directly after the applicator 62. Gripper 24 thus may receive sealing element 22 when legs 26 are completely extended and gripper 24 has an upwardly facing flat surface. In FIG. 1, this position occurs when gripper 24 is at the top of the circular path of gripper conveyor 60.

Alternate to a stack 23 and applicator 62, transfer of sealing element 22 may be from a roll of tape that is cut to a predefined length or label carrier film, the labels having preapplied adhesive, for example.

Sealing element 22 may be held onto gripper 24 by a vacuum, static or a mechanical gripper for example. The vacuum, for example, uses suction to hold sealing element 22 onto gripper 24 as closure device 20 travels around gripper conveyor 60. The vacuum releases suction when gripper 24 applies sealing element 22 to newspapers 50.

Gripper 24 travels around gripper conveyor 60 in direction E. Gripper conveyor 60 is driven by a motor 92 and synchronized with pocket conveyor 40, for example, by a controller 90 which also controls the motion of conveyor 40. As gripper 24 approaches pocket 42 legs 26 begin to close. Legs 26 may be spring-loaded open.

Figure 2:
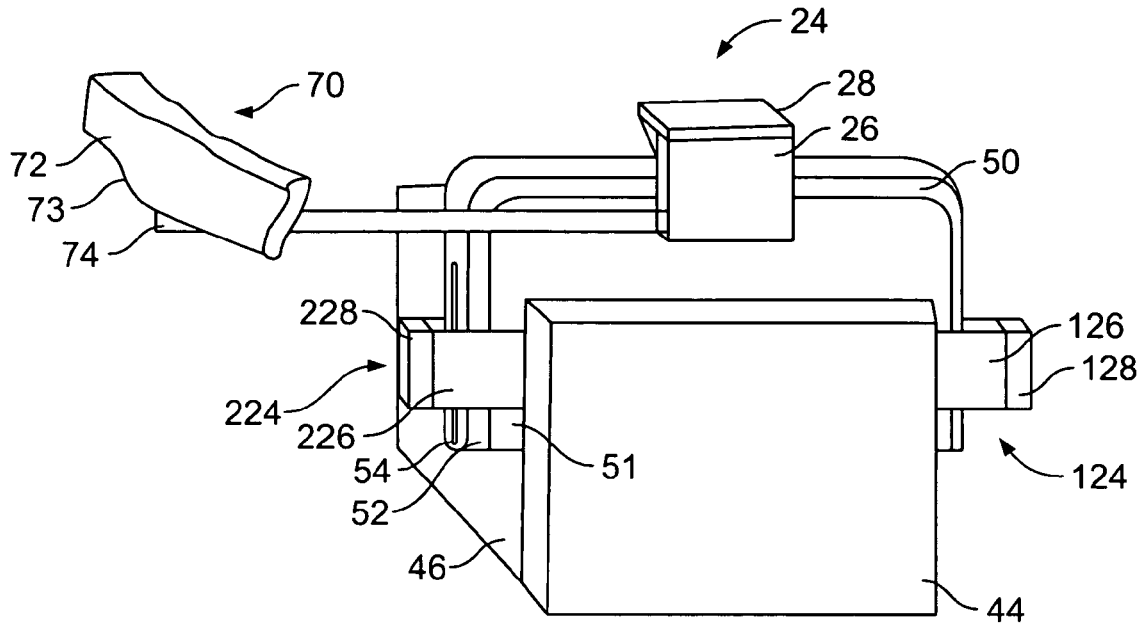
FIG. 2 shows a perspective view of a pocket, gripper and cam device.

As main section 28 moves along gripper conveyor 60, a cam device 70 may force legs 26 to rotate against the spring action (FIG. 2). Legs 26 continue to close as sealing element 22 and newspaper 50 come into contact with one another. Gripper 24 closes to bend sealing element 22 around the top end of newspaper 50 and applies pressure to newspaper 50. Then the vacuum may release suction on sealing element 22 while the pressure of gripper 24 applies sealing element 22 onto newspaper 50. Sealing element 22 adheres to newspaper 50 and gripper 24 releases to leave newspaper 50 sealed with sealing element 22.

After gripper 24 applies sealing element 22, gripper 24 continues to travel around gripper conveyor 60. Legs 26 of gripper 24 disengage newspaper 50 by rotating outward until gripper 24 lays flat. Gripper 24 continues to travel along gripper conveyor 60, receives another sealing element 22 and begins the cycle again.

Newspaper 50 then may be removed from pocket 42. Bottom gate 48 and movable wall 44 open to permit newspaper 50 to drop, for example onto a further conveyor below. Alternatively, gripper 24 can be used to remove newspaper 50 from the top of pocket 42 and to further transport newspaper 50.

Figure 3:
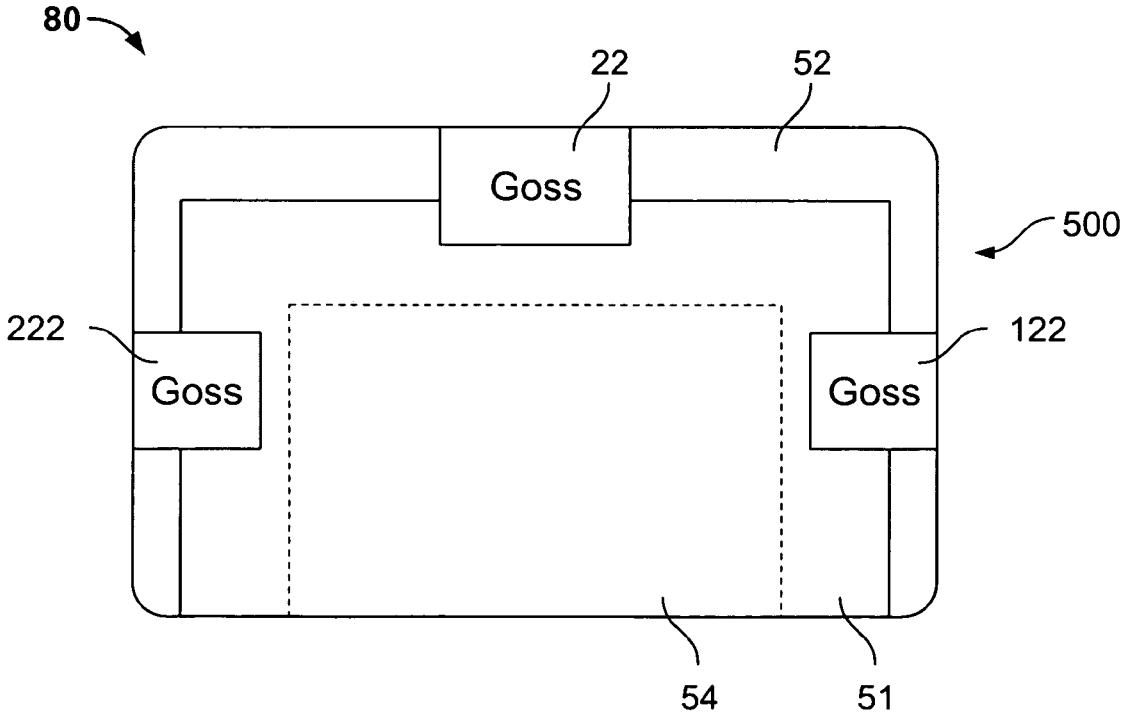
FIG. 3 shows a plan view of a sealed newspaper with a protective cover.

Newspaper 50 can be transported through another closure device wherein gripper conveyor 60 is adjacent to conveyor 40 so other sealing elements 122, 222 are applied to another side of newspaper 50, to result in a sealed newspaper 80 sealed on three sides as shown in FIG. 3.

Referring now to FIG. 2, it should be understood that three closure devices 20 deliver the sealing elements 22, 122, 222 shown in FIG. 3 via grippers 24, 124, 224. Grippers 24, 124, 224 have legs 26, 126, 226 and main sections 28, 128, 228, respectively which function in the same manner and may have the same construction as the closure device 20 in FIG. 1.

FIG. 2 also shows a perspective view of gripper 24, pocket 42, newspaper 50 and a cam device 70. Newspaper 50 may include a protective cover 51, also shown in FIG. 3. Cam device 70 includes a cam 72, a cam surface 73 and a cam follower 74 connected to leg 26.

Pocket 42 travels along pocket conveyor 40. Cam follower 74 interacts with cam surface 73 and cam 72. When gripper 24 nears approaching pocket 42, cam 72 and cam surface 73 cause cam follower 74 to move against spring-loaded legs 26. Legs 26 move inward, toward one another and toward pocket 42 until they are in contact with newspaper 50. Each leg 26 may have an individual cam follower and cam, or the legs 26 could be connected to close together via one cam follower. Legs 26 and gripper 24 apply pressure to newspaper 50 and sealing element 22 adheres to newspaper 50. A previously deposited protective cover 51 may be used to protect the outer layer of newspaper 50 and adhesive on sealing element 22 may thus only contact the protective cover 51.

FIG. 3 shows a sealed newspaper 80. Sealed newspaper 80 includes newspaper 50 after sealing elements 22, 122, 222 are applied by grippers 24, 124, 224 respectively. Sealed newspaper 80 may also include a protective cover 51. Sealing elements 22, 122, 222 may also include for example, advertising, promotions or other written communication, on the exposed surface of sealing element 22, 122, 222. Sealing elements 22, 122, 222 may adhere to protective cover 51. The dimensions of protective cover 51 may be less than the width and height of jacket 52 as shown.

Figure 4:
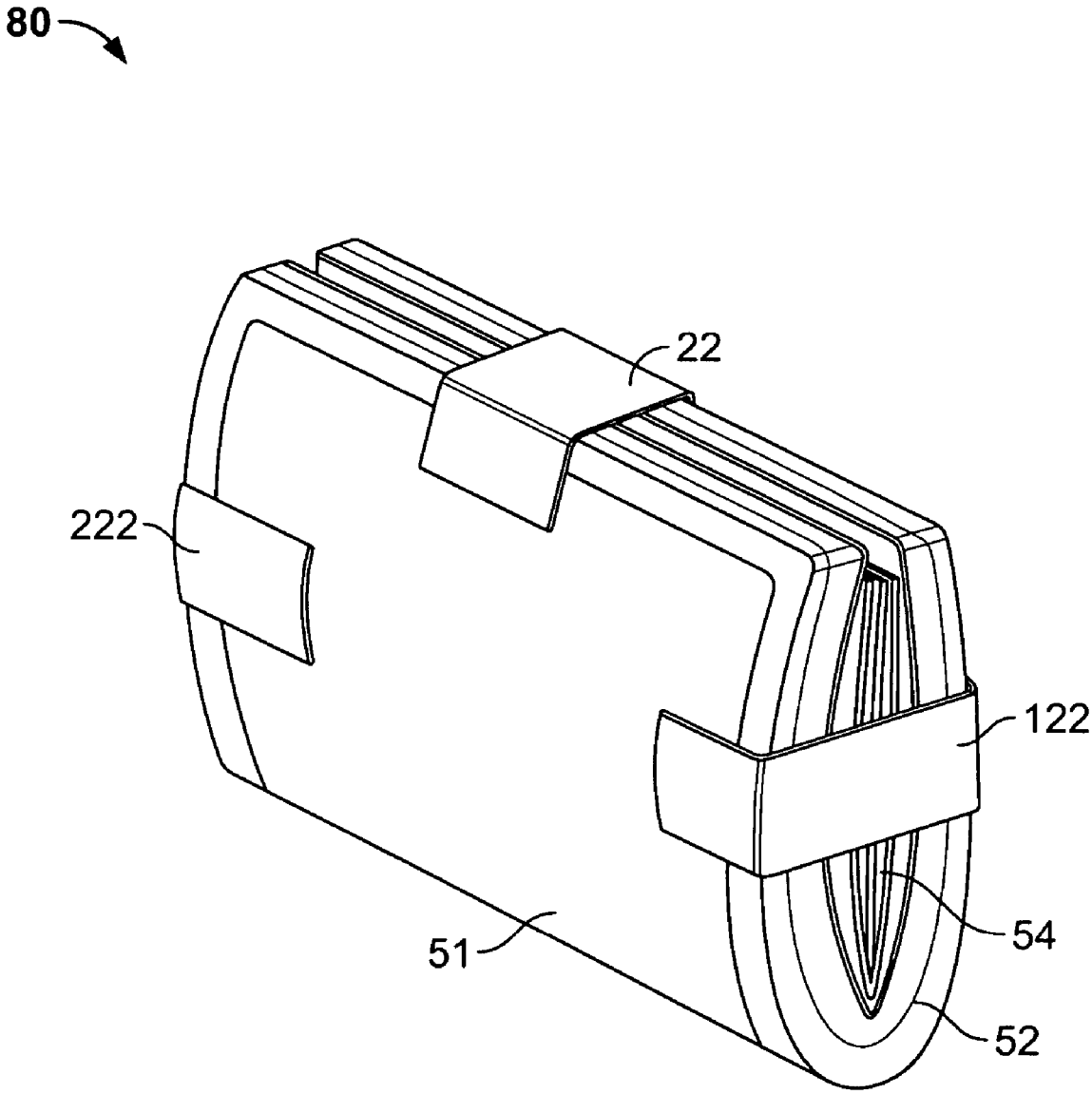
FIG. 4 shows a perspective view of a sealed newspaper with a protective cover.
Figure 5:
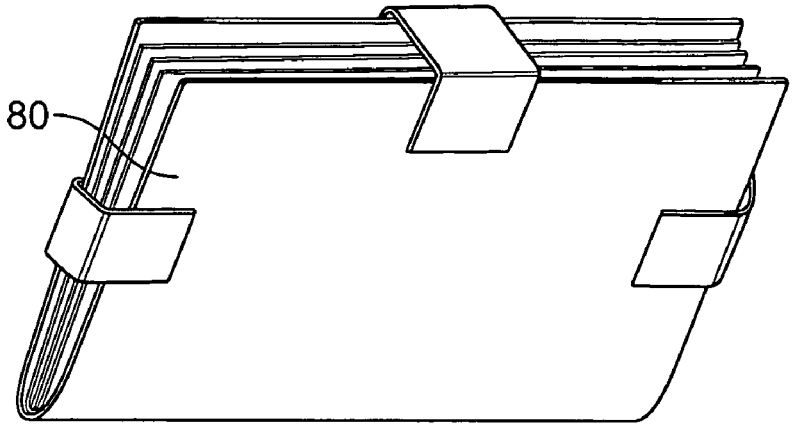
FIGS. 5, 6 and 7 show alternate sealed newspapers to the FIG. 4 embodiment.
Figure 6:
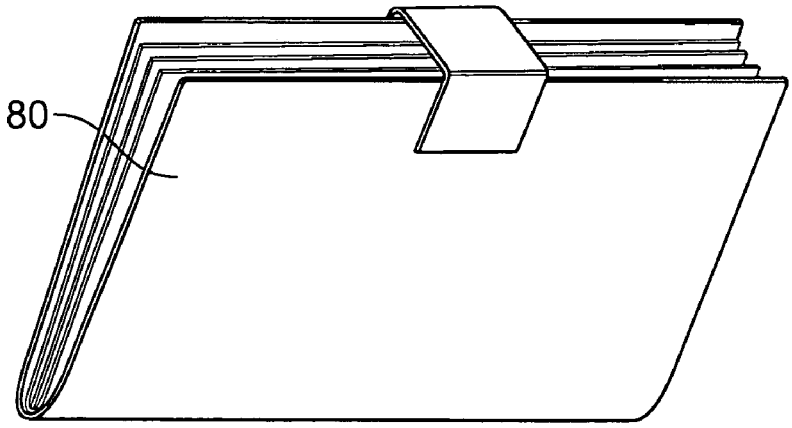
Figure 7:
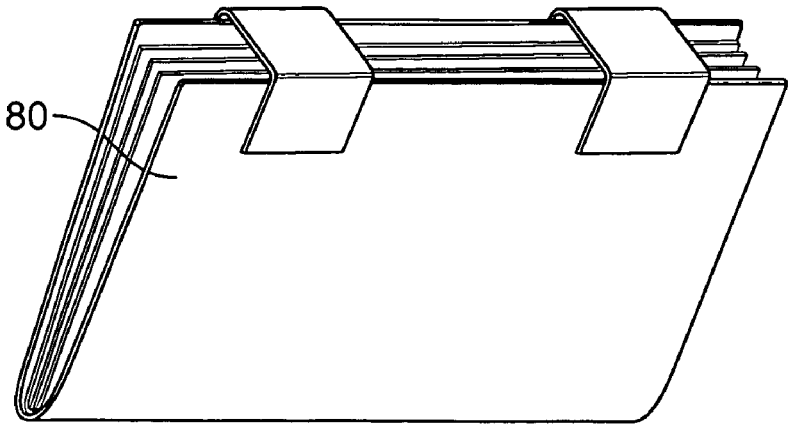

FIG. 4 shows a perspective view of sealed newspaper 80 after sealing elements 22, 122, 222 are applied. It should be understood that protective cover 51 need not be present, as shown for example, in FIG. 5. In that case, it is preferable if adhesive on sealing elements 22, 122, 222 does not remove ink from newspaper 50 and is easily removable. Inserts 54 are shown already deposited inside jacket 52. FIGS. 6 and 7 show two other possible embodiments for newspaper 80.

A printed product as defined herein may include a newspaper or other sheeted material such as a magazine.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. An inserter comprising:

a hopper section including a plurality of hoppers for delivering inserts;

a pocket conveyor including a plurality of pockets carrying a plurality of folded printed products, the printed products while in the pocket conveyor receiving at least one insert from the hopper section;

a plurality of walls of a pocket of the pocket conveyor gripping the printed product while the printed product is held in the pocket; and a closure device applying a sealing element to an edge of one of the plurality of printed products containing the at least one insert, the closure device located adjacent to the pocket conveyor at a location where the plurality of walls grip the one printed product.

2. The inserter as recited in claim 1 wherein the closure device includes grippers, each gripper having movable legs and a main section.

3. The inserter as recited in claim 2 wherein the closure device includes a cam follower attached to one of the grippers.

4. The inserter as recited in claim 2 wherein the grippers apply sealing elements to the printed products.

5. The inserter as recited in claim 1 wherein the closure device includes a sealing element storage or stack for holding the sealing elements and delivering the sealing elements.

6. The inserter as recited in claim 1 wherein the closure device includes an applicator for applying adhesive to the sealing elements.

7. The inserter as recited in claim 6 wherein the adhesive includes glue.

8. The inserter as recited in claim 1 wherein the conveyor is a newspaper conveyor.

9. The inserter as recited in claim 1 further comprising a controller for synchronizing motion of the conveyor and the closure device.

10. The inserter as recited in claim 1 wherein at least one of the pockets includes a bottom gate for releasing the printed product from the at least one pocket.

11. The inserter as recited in claim 1 wherein at least one of the pockets includes a movable wall for releasing the printed product from the at least one pocket.

12. The inserter as recited in claim 1 wherein the sealing element is tape.

13. The inserter as recited in claim 1 wherein the closure device located adjacent to the pocket conveyor is located above the pocket conveyor.

14. A method for closing a plurality of folded printed products while the printed products are carried along a pocket conveyor including a plurality of pockets comprising the steps of:

moving the plurality of the folded printed products through a hopper section, inserts being deposited into the folded printed products;

moving the plurality of the folded printed products having the inserts along the pocket conveyor in the plurality of pockets;

synchronizing a closure device with the pocket conveyor;

gripping at least one folded printed product in a corresponding pocket with a plurality of walls of the corresponding pocket to hold the at least one folded printed product;

applying a sealing element to the at least one folded printed product having the inserts using the closure device so as to define a sealed printed product; and transporting the sealed printed product further along the pocket conveyor.

15. The method as recited in claim 14 wherein the sealed printed product is a newspaper.

16. The method as recited in claim 15 wherein the closure device includes a gripper and the applying step includes making contact with the newspaper by rotating the legs of the gripper around an edge of the newspaper and applying pressure to the newspaper from the legs of the gripper.

17. The method as recited in claim 14 wherein the step of applying a sealing element to the one folded printed product includes the closure device gripping the printed product with inserts from above.

18. An inserter comprising:

a hopper section including a plurality of hoppers for delivering inserts;

a pocket conveyor including a plurality of pockets, the plurality of pockets carrying a plurality of folded printed products, the printed products while in pocket conveyor receiving at least one insert from the hopper section;

a first closure device adjacent to the pocket conveyor applying a first sealing element to an edge of one of the plurality of printed products containing the at least one insert; and a second closure device adjacent to the pocket conveyor applying a second sealing element to a further edge of the one printed product containing the at least one insert;

the first and second closure devices applying the first and second sealing elements while the one printed product is gripped by a plurality of walls of the corresponding pocket.

19. The inserter as recited in claim 18 wherein the first or second closure devices include grippers, each gripper having movable legs and a main section for applying sealing elements to the printed products.

20. The inserter as recited in claim 18 wherein the first or second closure devices include a cam follower attached to one of the grippers.

21. The inserter as recited in claim 18 wherein the first or second closure device includes a sealing element storage or stack for holding the sealing elements and delivering the sealing elements.

22. The inserter as recited in claim 18 wherein the first or second closure device includes an applicator for applying adhesive to the sealing elements.

23. The inserter as recited in claim 18 wherein the conveyor is a newspaper conveyor.

24. The inserter as recited in claim 18 further comprising a controller for synchronizing motion of the conveyor and the first or second closure device.

* * * * *